US006549738B2

(12) United States Patent
Otani et al.

(10) Patent No.: US 6,549,738 B2
(45) Date of Patent: Apr. 15, 2003

(54) IMAGE FORMING CARTRIDGE AND IMAGE FORMING APPARATUS HAVING A PHOTORECEPTOR DRUM THAT ROTATES AT A CONSTANT VELOCITY AND IS STABLY GROUNDED

(75) Inventors: Shinichi Otani, Tokyo (JP); Hiroaki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/924,951

(22) Filed: Aug. 9, 2001

(65) Prior Publication Data

US 2002/0025188 A1 Feb. 28, 2002

(30) Foreign Application Priority Data

Aug. 30, 2000 (JP) ..... 2000-261303

(51) Int. Cl.[7] ..... G03G 15/00
(52) U.S. Cl. ..... 399/117; 399/167
(58) Field of Search ..... 399/111, 116, 399/117, 159, 167

(56) References Cited

U.S. PATENT DOCUMENTS 5,953,562 A * 9/1999 Kawaguchi et al. ..... 399/117
6,058,280 A * 5/2000 Kumar et al. ..... 399/117
6,336,017 B1 * 1/2002 Miyamoto et al. ..... 399/116

* cited by examiner

*Primary Examiner*—Hoan Tran
(74) *Attorney, Agent, or Firm*—Rabin & Berdo, PC

(57) ABSTRACT

An image forming cartridge and an image forming apparatus equipped with the image forming cartridge is provided which enables a photoreceptor drum to be surely grounded and costs to be reduced. The image forming cartridge is made up of the photoreceptor drum having conductive members, a conductive drum supporting member being fixed in a manner to contact the conductive member, a gear to be contacted with a driving gear when being placed at the image forming apparatus and to be adapted to transfer rotation from the driving gear to the photoreceptor drum and to produce thrust at a time of transfer of rotation, a drum shaft composed of conductors and contacting a part of inner circumferential face of the drum supporting member, collar composed of conductors and being fitted into the drum shaft and an E ring to position the collar.

16 Claims, 9 Drawing Sheets

IMAGE FORMING CARTRIDGE AND IMAGE FORMING APPARATUS HAVING A PHOTORECEPTOR DRUM THAT ROTATES AT A CONSTANT VELOCITY AND IS STABLY GROUNDED

BACKGROUND OF THE INVENTION

1. Field of the Invention

The present invention relates to an image forming cartridge and image forming apparatus using an electrophotographic method.

2. Description of the Related Art

In the conventional image forming apparatus employing the electrophtographic method, the image forming cartridge is provided in a manner so as to be freely detachable and attachable. The image forming cartridge has a photoreceptor drum inside the cartridge and also a charging unit, exposing unit, developing unit, transferring unit and cleaning unit in an area surrounding the photoreceptor drum. All of the above members are. covered by a cartridge case, thus making up the image forming cartridge.

Moreover, in the above photoreceptor drum, a rotary axis is fitted into a bearing section mounted at a center of a flange, thus causing the photoreceptor drum to be grounded (refer to Japanese Utility Model Application No. Sho 62-49175).

Configurations of the conventional image forming cartridge will be described below. FIG. 12 is a cross-sectional view describing configurations of main portions of the conventional image forming cartridge.

As shown in FIG. 12, a photoreceptor drum 3 is provided in a cartridge case 2 covering the entire image forming cartridge 1. The photoreceptor drum 3 is made up of an electric charge generating layer and an electric charge transferring layer formed on a conductive substrate composed of a cylinder-shaped aluminum alloy member or a like. Into both ends of the photoreceptor drum, drum supporting members 4 and 5 made of a metal or a conductive resin are inserted by the application of pressure or bonded. An axial section of the drum supporting member 4 is inserted, in an involved state, in a bearing hole 2*a* formed in the cartridge case 2 in a manner so as to be rotational. This enables the photoreceptor drum 3 to be supported by the bearing hole 2 so as to be freely rotational relative to the cartridge case 2. Moreover, a gear 6 is provided at a part of areas surrounding the drum supporting member 4.

Positioning pins 8, 9 are attached to a frame 7 making up the image forming apparatus. Positioning pins 8 and 9 extrude toward a direction of the inside of the apparatus. Each of the positioning pins 8 and 9 is fitted into a rotation center hole formed at a center of each of the drum supporting members 4 and 5. A ring-shaped conductive spring member 10 is attached to an end face inside the drum supporting member 4. The conductive spring member 10 is so disposed that its edge contacts inner faces surrounding the photoreceptor drum 3 and so that an extruding portion 10*a* extending from the edge of the conductive spring member 10 toward the center is in contact with an end portion of the positioning pin 8.

Thus, the photoreceptor drum 3 is electrically connected through the conductive spring member 10 and the positioning pin 8 to the frame 7 and is grounded through the frame 7.

However, if an error in out-of-roundness between an internally circumferential wall face making up the rotation center hole of the drum supporting member 4 and a circumferential face of the positioning pin 8 is large, when the drum supporting member 4 rotates at a time of the rotation of the photoreceptor drum 3, since the circumferential face of the positioning pin 8 contacts the internally circumferential wall face in a sliding manner, there is a risk of changes in rotation speed of the photoreceptor drum 3. Therefore, though a method is available in which a bearing is provided between the positioning pin 8 and the rotation center hole, since it causes an increase in the number of components, costs are increased.

On the other hand, by decreasing a thickness of the drum supporting member 4 to reduce an area contacting faces surrounding the positioning pin 8, it is made possible to decrease an amount of contact in a sliding manner. However, in the case of the drum supporting member 4 made of the conductive resin, if the contact area is made smaller, since the drum supporting member 4 has inferior conductivity compared with other drum supporting members made of conductive metals, stable grounding of the photoreceptor drum 3 is impossible. This causes a low image quality and also causes noise, thus producing the risk of malfunctions.

SUMMARY OF THE INVENTION

In view of the above, it is an object of the present invention to provide an image forming cartridge having configurations that enable a photoreceptor drum to rotate with a constant velocity and the photoreceptor drum to be stably grounded.

It is another object of the present invention to provide an image forming apparatus having configurations that enable the photoreceptor drum to rotate with a constant velocity and the photoreceptor drum to be stably grounded.

According to a first aspect of the present invention, there is provided an image forming cartridge having a photoreceptor drum placed in a cartridge case and being attached to an image forming apparatus through the cartridge case in a manner so as to be detachable and attachable, including:

- an electrically conductive axial member placed on a rotation center axis in the photoreceptor drum and being supported by the cartridge case;
- an electrically conductive drum supporting member placed on the axial member in a manner so as to be rotational and movable and supporting the photoreceptor drum on the axial member in a manner so as to be rotational;
- a collar placed on a circumferential face near the drum supporting member of the axial member in a manner so as to be rotational and movable and being composed of a conductor so that the photoreceptor drum is grounded through the axial member;
- a thrust supplying unit to give thrust to the photoreceptor drum to press the drum supporting member, by application of pressure and through the photoreceptor drum, on the collar so as to cause the drum supporting member to contact the collar; and
- a stopper used to prevent the pressed collar from moving on the axial member.

In the foregoing, a preferable mode is one wherein the drum supporting member is formed of a conductive resin and has a cone-shaped placement hole used to reduce an area contacting faces surrounding the axial member.

Also, a preferable mode is one wherein an end of the axial member penetrates the cartridge case and the end of the axial member contacts, in a struck manner, an elastic member used for grounding which is fixed to a frame constituting the image forming apparatus.

Also, a preferable mode is one wherein the thrust supplying unit is made up of a helical gear for rotation which is fixed coaxially to an end of the photoreceptor drum and of a driving gear composed of other helical gear which engages with the helical gear.

Also, a preferable mode is one wherein the stopper is a ring member to be fixed to a face surrounding the axial member.

Also, a preferable mode is one wherein the stopper is a wall face disposed opposite to the collar of the cartridge case.

According to a second aspect of the present invention, there is provided an image forming cartridge having a photoreceptor drum placed in a cartridge case and being attached to an image forming apparatus through the cartridge case in a manner so as to be detachable and attachable, including:

a shaft placed on a rotation center axis in the photoreceptor drum, both ends of which is supported, in a fixed manner, by the cartridge case;

a drum supporting member composed of a conductive resin being fixed internally on the side of one end of the photoreceptor drum and being placed on a circumferential face on the side of the one end of the shaft in a manner so as to be rotational and movable and supporting the photoreceptor drum or the shaft in a manner so as to be rotational;

a collar placed on a circumferential face near the drum supporting member of the axial member in a manner so as to be rotational and movable and being composed of a conductor so that the photoreceptor drum is grounded through the axial member;

a helical gear being coaxially fixed to the other end of the photoreceptor drum and being placed on a circumferential face on the side of the other end of the shaft which engages with a helical gear for driving the image forming apparatus and gives thrust to the photoreceptor drum to press the drum supporting member, by application of pressure and through the photoreceptor drum, on the collar so as to cause the drum supporting member to contact the collar; and a stopper used to prevent the pressed collar from moving on the axial member.

In the foregoing, a preferable mode is one wherein the drum supporting member has a cone-shaped placement hole used to reduce an area contacting faces surrounding the axial member and a small diameter portion contacting faces surrounding the shaft.

Also, a preferable mode is one wherein an end of the shaft penetrates the cartridge case and the end of the shaft contacts, in a struck manner, an elastic member used for grounding which is fixed to a frame constituting the image forming apparatus.

Also, a preferable mode is one wherein the stopper is a ring member to be fixed to a face surrounding the axial member.

Also, a preferable mode is one wherein the stopper is a wall face disposed opposite to the collar of the cartridge case.

According to a third aspect of the present invention, there is provided an image forming apparatus provided with a photoreceptor drum in a manner so as to be rotational, including:

an electrically conductive axial member being supported by an axis in a manner so as to be rotational on a rotation center axis in the photoreceptor drum;

an electrically conductive drum supporting member placed on the axial member in a manner so as to be rotational and movable and supporting the photoreceptor drum on the axial member in a manner so as to be rotational;

a collar placed on a circumferential face near the drum supporting member of the axial member in a manner so as to be rotational and movable and being composed of a conductor so that the photoreceptor drum is grounded through the axial member;

a thrust supplying unit to give thrust to the photoreceptor drum to press the drum supporting member, by application of pressure and through the photoreceptor drum, on the collar so as to cause the drum supporting member to contact the collar; and a stopper used to prevent the pressed collar from moving on the axial member.

Also, a preferable mode is one wherein the drum supporting member is formed of a conductive resin and has a cone-shaped placement hole used to reduce an area contacting faces surrounding the axial member.

Also, a preferable mode is one wherein the thrust supplying unit is made up of a helical gear for rotation which is fixed coaxially to an end of the photoreceptor drum and of a driving gear composed of other helical gear which engages with the helical gear.

Furthermore, a preferable mode is one the stopper is a ring member to be fixed to a face surrounding the axial member.

With the above configuration, by causing the drum supporting member to contact the collar, the photoreceptor drum can be reliably grounded through the axial member. Therefore, it is possible to prevent the image quality from becoming low and the malfunction caused noise from occurring.

With another configuration, the photoreceptor drum can be reliably grounded by using the collar or a like and therefore the area contacting the axial member of the drum supporting member can be also made smaller. Therefore, the sliding resistance between the axial member and drum supporting member can be reduced, which enables the photoreceptor drum to be rotated smoothly and eliminates the need for attachment of the bearing.

BRIEF DESCRIPTION OF THE DRAWINGS

The above and other objects, advantages and features of the present invention will be more apparent from the following description taken in conjunction with the accompanying drawings in which.

DESCRIPTION OF THE PREFERRED EMBODIMENTS

Best modes of carrying out the present invention will be described in further detail using various embodiments with reference to the accompanying drawings.

Embodiments

Figure 1:
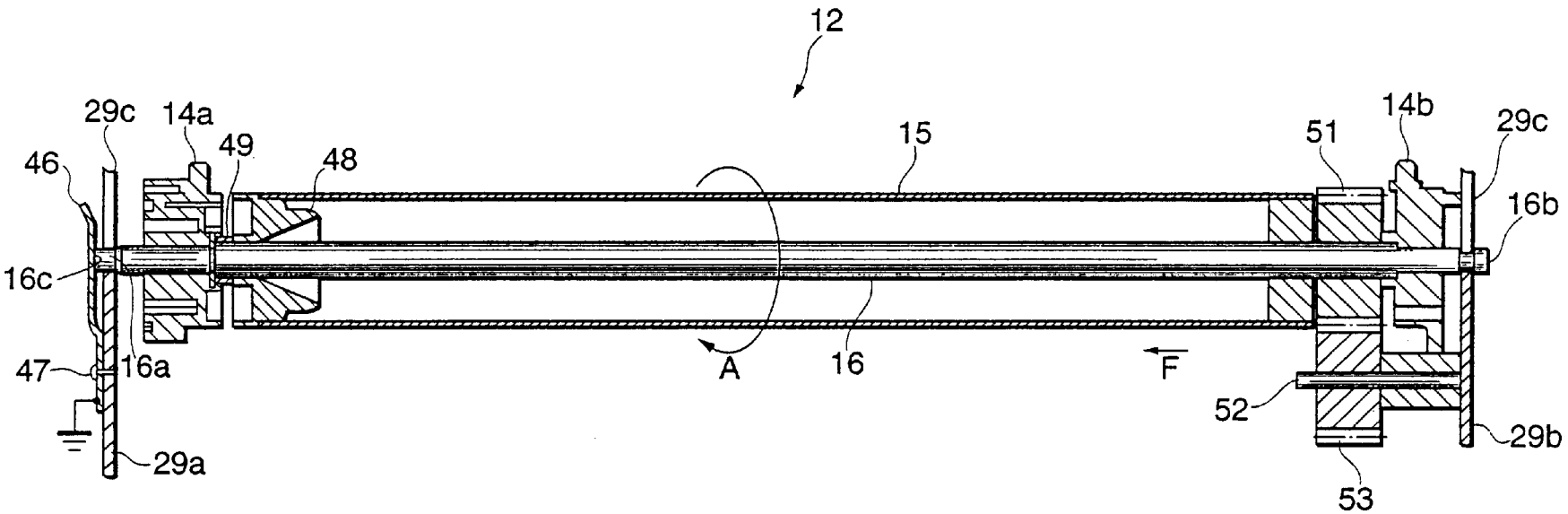
FIG. 1 is a cross-sectional view describing configurations of main portions of an image forming cartridge according to an embodiment of the present invention.
Figure 2:
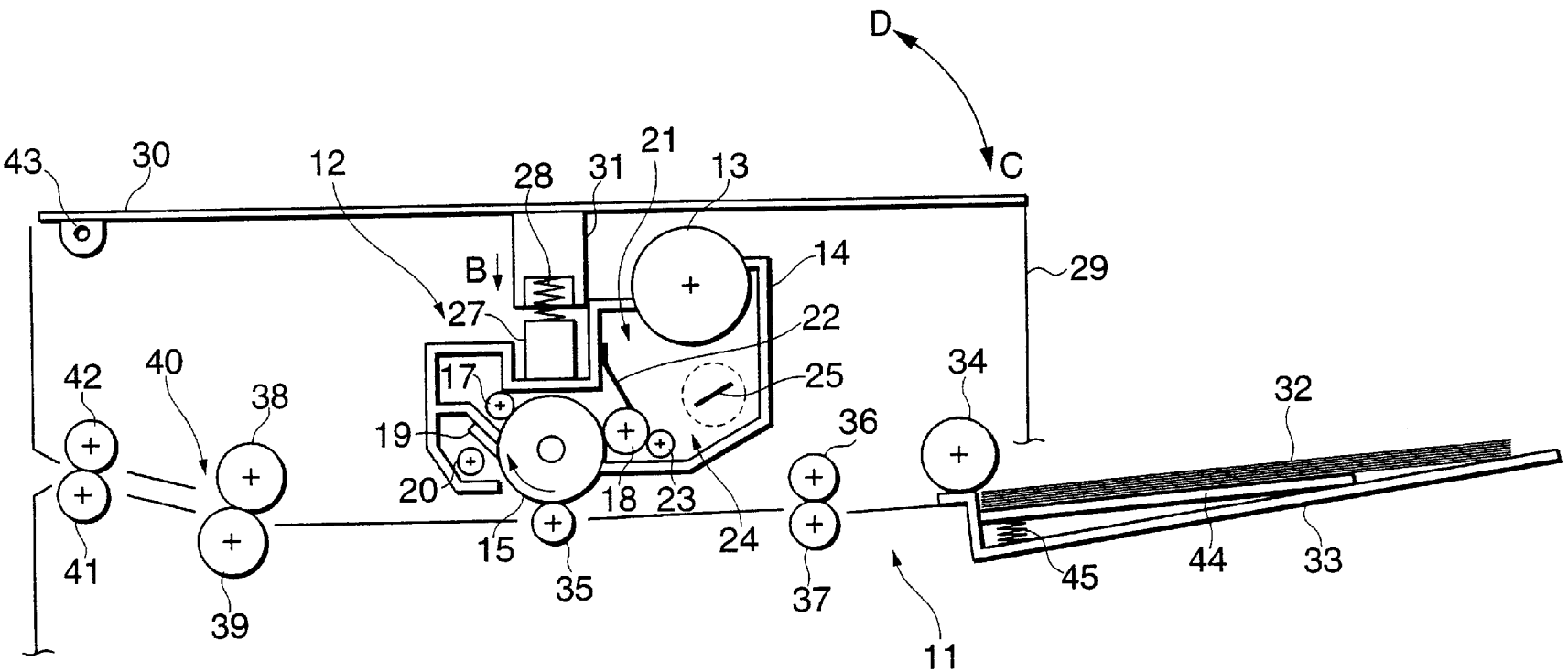
FIG. 2 is a schematic diagram showing configurations of an image forming apparatus in which the image forming cartridge of FIG. 1 is incorporated.
Figure 3:
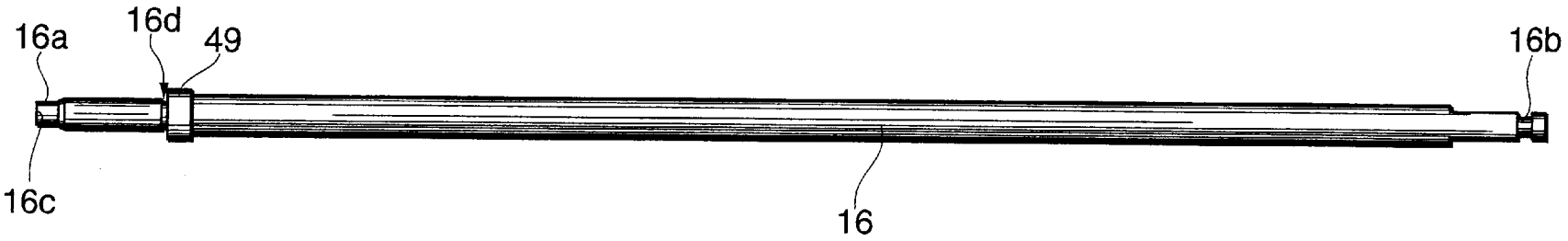
FIG. 3 is a front view showing a drum shaft provided with a collar employed in the embodiment of the present invention.
Figure 4:
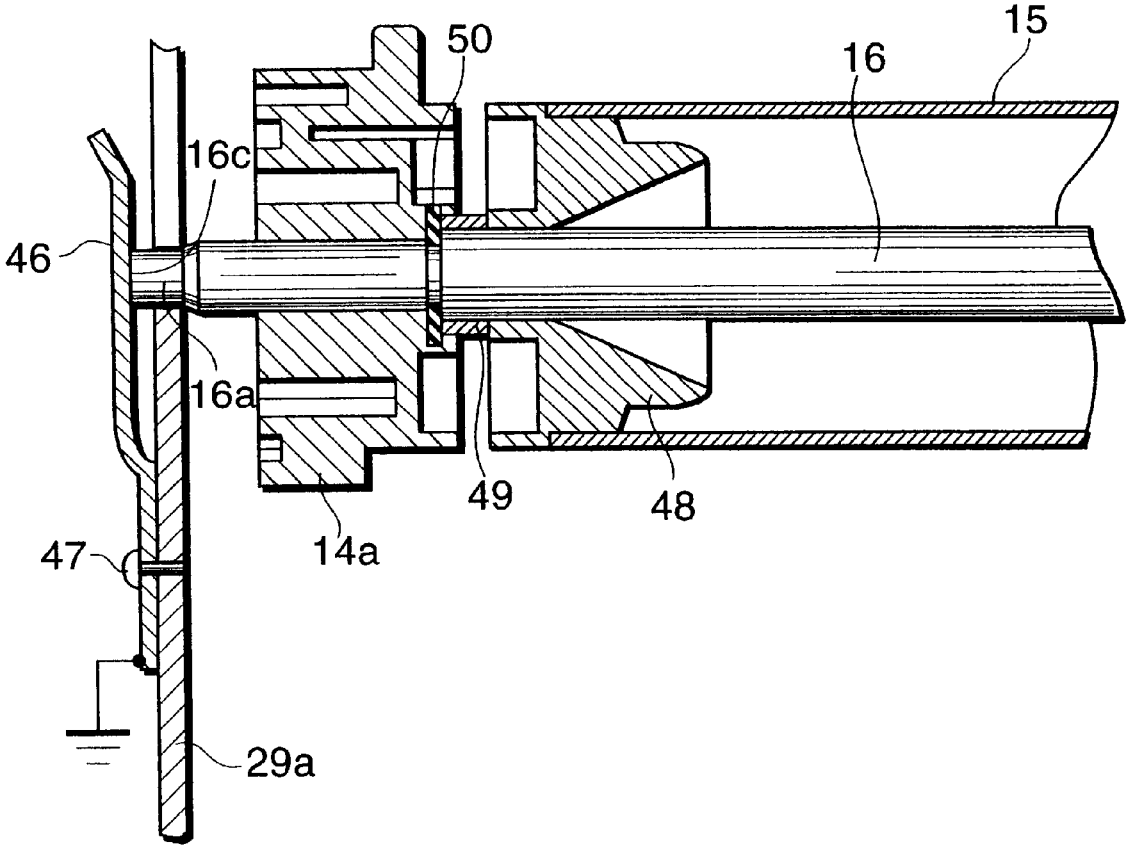
FIG. 4 is an expanded sectional view of main portions of the image forming cartridge of FIG. 1.
Figure 5:
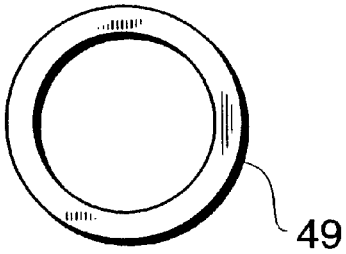
FIG. 5 is a front view of the collar employed in the embodiment of the present invention.
Figure 6:
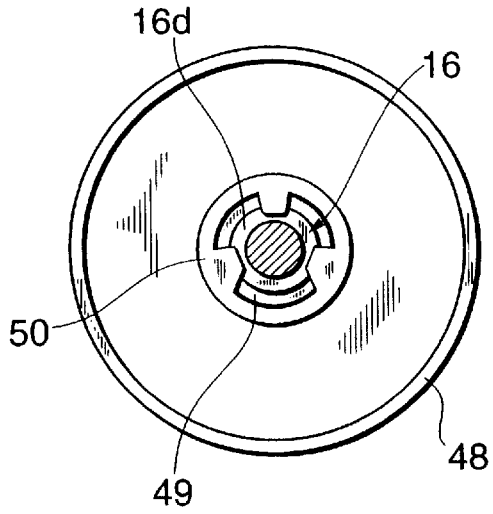
FIG. 6 is a side view of the collar employed in the embodiment of the present invention.
Figure 7:
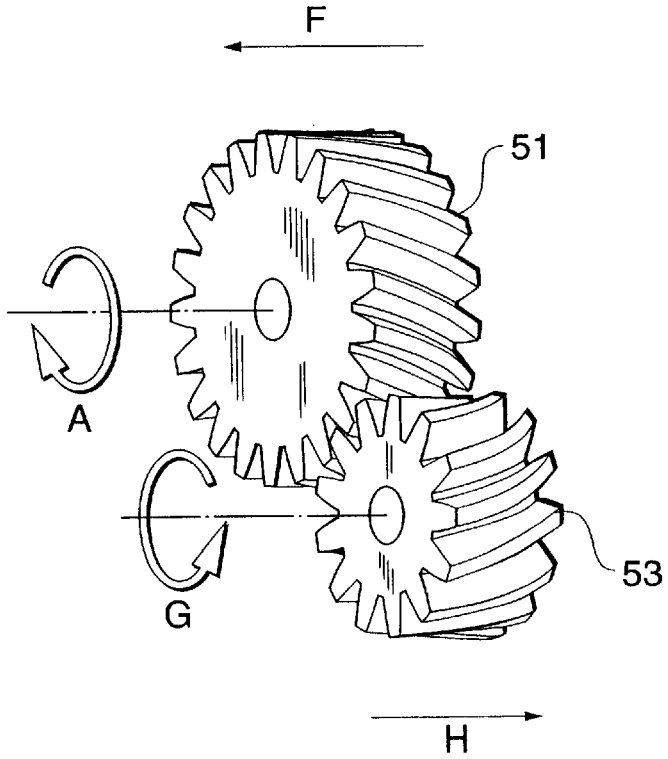
FIG. 7 is a perspective view of a rotation transferring unit employed in the embodiment of the present invention.
Figure 8:
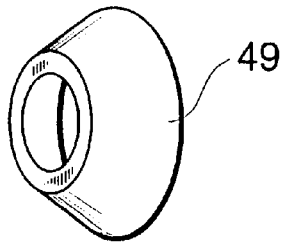
FIG. 8 is a perspective view of a collar employed in other embodiment.
Figure 9:
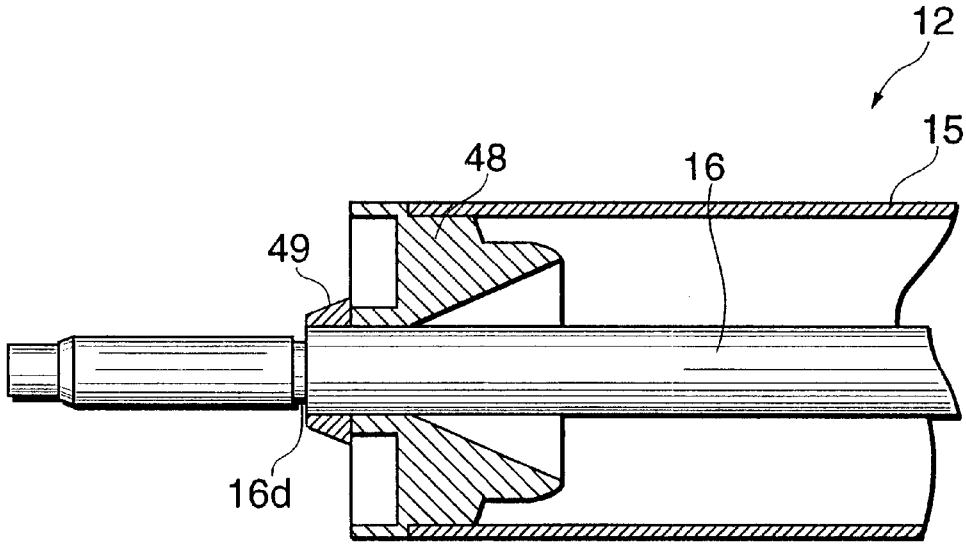
FIG. 9 is a cross-sectional view describing configurations of main portions of an image forming cartridge provided with the collar of FIG. 8.

Same reference numbers are assigned to components used in common to each of figures in the embodiments. FIG. 1 is a cross-sectional view describing configurations of main portions of an image forming cartridge according to an embodiment of the present invention. FIG. 2 is a schematic diagram showing configurations of an image forming apparatus in which the image forming cartridge of FIG. 1 is incorporated. FIG. 3 is a front view showing a drum shaft provided with a collar employed in the embodiment of the present invention. FIG. 4 is an expanded sectional view of main portions of the image forming cartridge of FIG. 1. FIG. 5 is a front view of the collar employed in the embodiment of the present invention. FIG. 6 is a side view of the collar employed in the embodiment of the present invention. FIG. 7 is a perspective view of a rotation transferring unit employed in the embodiment of the present invention. FIG. 8 is a perspective view of a collar employed in another embodiment of the present invention. FIG. 9 is a partly cross-sectional view describing configurations of main portions of the image forming cartridge provided with the collar of FIG. 8.

As shown in FIG. 2, the image forming apparatus employing the electrophotographic method is provided with an image forming cartridge 12 and a toner cartridge 13 in a manner so as to be freely detachable and attachable. The image forming cartridge 12 has a cartridge case 14 within which a photoreceptor drum 15 being an electrostatic latent image supporter is placed. In areas surrounding the photoreceptor drum 15 are disposed a charging roller 17 used to cause a surface of the photoreceptor drum 15 to become electrostatically charged, a developing roller 18 and a cleaning blade 19 used to remove residual toner left on the surface of the photoreceptor drum 15 after transferring operations have been performed. The toner removed from the surface of the photoreceptor drum 15 by the cleaning blade 19 is moved by a spiral screw 20 (not shown) to a waste toner box to be stored therein.

The developing roller 18 makes up a developing device 21 and is composed of semiconductive. rubber materials. A developing blade 22 and a sponge roller 23 are in contact with outer faces surrounding the developing roller 18 in a pressurized state. The developing blade 22 and the sponge roller 23, together with the cartridge case 14, make up a toner storing section 24. The toner storing section 24 is provided with a stirring member 25 used to stir the toner and on the upper side of the stirring member 25 is disposed the toner cartridge 13. The toner cartridge 13 is replaced when the toner therein has run out.

Moreover, the charging roller 17, developing roller 18, sponge roller 23, stirring member 25 or the like are supported by the cartridge case 14 in a manner so as to be freely rotational.

Next, operations of the developing device 21 will be described below.

First, the nonmagnetic toner stored in the toner storing section 24 is fed through the sponge roller 23 to the developing roller 18 and is further conveyed to the developing blade 22 by rotation of the developing roller 18 and is then made thin by the developing blade 22 on the developing roller 18. After that, the thin-layered toner is fed by the rotation of the developing roller 18 to a developing section disposed between the developing roller 18 and the photoreceptor drum 15 and adheres to an electrostatic latent image forming portion in which a toner image is formed.

The toner, when it is made thin by the developing blade 22, is strongly rubbed by the developing roller 18 and the developing blade 22, which causes the toner to be charged by friction. In the embodiment of the present invention, the above toner is charged to be of negative polarity.

Next, operations of an LED (Light Emitting Diode) head 27 disposed between the charging roller 17 and the developing roller 18 and placed in a position opposite to the photoreceptor drum 15 will be explained below. The LED head 27 is made up of an LED array composed of a plurality of LED devices (not shown), a substrate (not shown) on which a driver IC to drive the LED array is placed, a rod lens array (not shown) to gather light from each of the LED devices and is adapted to cause each of the LED devices to emit light in a manner to respond to image data transmitted from outside and to cause the surface of the photoreceptor drum 15 to be exposed and the electrostatic latent image to be formed on the surface of the photoreceptor drum 15. Then, the toner existing on the developing roller 18 adheres electrostatically to the electrostatic latent image portion and, as a result, the toner image is formed. Moreover, to the LED head 27 is attached one end of a spring 28 and then momentum is given to the LED head in the direction of an arrow B by the spring 28. The other end of the spring 28 is supported by a supporting member 31 being fixed to an open/close cover 30 (to be described later).

A transferring roller 35 is provided in areas surrounding the photoreceptor drum 15. The transferring roller 35 is pressed on the photoreceptor drum 15 by specified force and is adapted to transfer the toner image formed on the surface of the photoreceptor drum 15 to paper fed from a resist roller (to be described later). Moreover, a fixing device 40 is provided on a downstream side of the paper feeding direction relative to the position of the developing device 21. The fixing device 40 is made up of a heating roller 38 and a pressurizing roller 39.

The image forming apparatus 11 is provided with a paper feeding section 33. The paper feeding section 33 has a hopper stage 44. Paper 32 is stacked on the hopper stage 44 and one end of a spring 45 is attached to a part of the hopper stage 44. The paper 32 is pressed by pressurized force of the spring 45 toward a feeding roller 34 disposed on an upper side of the spring 44. The other end of the spring 45 is attached to a bottom of the paper feeding section 33. The paper 32 stacked on the paper feeding section 33 by rotation of the feeding roller 34 is sequentially fed into the image forming apparatus 11.

The fed paper 32 is conveyed to the resist rollers 36 and 37 and then is further conveyed to the transferring section between the photoreceptor drum 15 and the transferring roller 35, where the toner image on the photoreceptor drum 15 is transferred to the paper 32 by the transferring roller 35. The paper 32 is then conveyed to the fixing device 40 where the toner image is fixed by the heating roller 38 and pressurizing roller 39. The paper with the toner image fixed is discharged outside of the image forming apparatus 11 by discharging rollers 41 and 42.

Also, the image forming apparatus 11 is provided with the open/close cover 30. The open/close cover 30 is attached so as to be freely rotatable around a hinge 43 in the direction C-D of an arrow relative to a frame 29. The image forming cartridge 12 can be detached from or attached to the image forming apparatus 11 in a state in which the open/close cover 30 is opened.

Next, configurations and operations of the photoreceptor drum 15 will be described below. The photoreceptor drum 15 is made up of an electric charge generating layer and an electric charge transferring layer formed on a conductive substrate composed of a cylinder-shaped aluminum alloy member or the like. A metal drum shaft 16 is provided in the photoreceptor drum 15. The metal drum shaft 16 serves as the axial member composed of a conductor, as shown in FIG. 1 and FIG. 3. Each end of the drum shaft 16 penetrates each of bearing holes formed in each of the sides walls 14*a* and 14*b* of the cartridge case 14.

In each of the frames 29*a* and 29*b* of the image forming apparatus 11 is formed. inserting long holes 29*c* along an up-and-down direction. Each of the ends 16*a* and 16*b* of the drum shaft 16 also penetrates each of the inserting long holes 29*c* of the frames 29*a* and 29*b* in a state in which each of the ends 16*a* and 16*b* of the drum shaft 16 extrudes from each of the side walls 14*a* and 14*b* of the cartridge case 14. This causes the drum shaft 16 to be positioned relative to the frame 29 of the image forming apparatus 11. At a part of the drum shaft 16 is formed a groove 16*d* into which a part of an E ring (to be described later) is inserted (refer to FIG. 3 and FIG. 4).

In the inside at one end of the photoreceptor drum 15, as shown in FIG. 1 and FIG. 4, an electrically conductive supporting member 48 is inserted by the application of pressure or bonded using a conductive adhesive. The drum supporting member 48 and a gear described later are placed on the drum shaft 16 in a manner so as to be rotational. Therefore, the photoreceptor drum 15 becomes rotational around the drum shaft 16 in the direction of an arrow A shown in FIG. 1. In the drum supporting member 48, only its small diameter portion disposed opposite to a collar 49 is in contact with a face surrounding the drum shaft 16. The member 48 has a cone-shaped hole section being in non-contact with the face surrounding the drum shaft 16 and is composed of a conductive metal.

The collar 49 is placed on an upper side of the end extruding from the photoreceptor drum 15 of the drum shaft 16 in a manner so as to be rotational and movable. Moreover, to an end of the drum shaft 16 is attached an E ring 50 in a state in which it is fitted into a groove 16*d,* as shown in FIG. 4 and FIG. 6. The collar 49 is in contact with the E ring 50. The E ring 50 serves as a stopper to inhibit the movement of the collar 49 when being pressed through the drum supporting member 48 by thrust and to cause the collar 49 to surely contact the drum supporting member 48 electrically.

In FIG. 1 and FIG. 4, a conductive spring member 46 is provided to the frame 29*a* with a pin 47. The spring member 46 is grounded and its free end is in contact with an end face 16*c* of the drum shaft 16 in a pressurized manner. Therefore, the end face 16*c* of the drum shaft 16 can be reliably connected to the spring member 46 electrically.

As a result, the photoreceptor drum 15, since it is electrically connected through the drum supporting member 48 to the drum shaft 16 or through the drum supporting member 48, collar 49 and E ring 50 to the drum shaft 16, is grounded through the spring member 46.

As shown in FIG. 1, to the other end of the photoreceptor drum 15 is bonded a gear 51 being a rotation transferring unit also serving as the drum supporting member, by using the conductive adhesive. The gear 51 engages with a driving gear 53. The driving gear 53 is fitted into a fixed shaft 52 being fixed to the frame 29*b* in a manner so as to be freely rotational. Therefore, when the driving gear 53 is driven and the gear 51 is rotated, the photoreceptor drum 15 is rotated in the direction of an arrow A shown in FIG. 2. The gear 51 and the driving gear 53, as shown in FIG. 7, are made up of helical gears with angles of torsion of teeth formed in the direction opposite to each other. Therefore, when the driving gear 53 is rotated in the direction of an arrow G, the gear 51 rotates in the direction of the arrow A. At this point, thrust is produced in the driving gear 53 in the direction of an arrow H and the thrust is also produced in the gear 51 in the direction of an arrow F. As a result, the drum supporting member 48 is pressed on the collar 49 by thrust produced in the direction of the arrow F. Moreover, the gear 51 also serves as the drum supporting member. Since it requires no conductivity, it is made up of, for example, a polyacetal resin containing a large amount of lubricant, which enables a smooth rotation of the gear on the drum shaft 16 even if the area contacting faces surrounding the drum shaft 16 is large.

The other end of the drum shaft 16 is so configured that it penetrates the side wall 14*b* of the cartridge case 14 and further extrudes from the side wall 14*b* and a groove formed at the end 16*b* is inserted in the frame 29 in an involved state. This causes the spring member 46 to contact an end face 16*c* on one end of the drum shaft 16 by elastic force which ensures reliable contact with the drum shaft 16 and which also applies a large thrust to the drum supporting member 48, thus enabling the collar 49 to be surely pressed on the E ring 50.

In the image forming cartridge 12, a transfer gear (not shown) is provided so that the charging roller 17, developing roller 18, spiral screw 20, sponge roller 23, stirring member 25 or the like can be rotated through the gear 51.

Moreover, terminals (not shown) are connected to the charging roller 17, developing roller 18 and sponge roller 23 and each of the terminals is extruded out of the cartridge case 14. In the frame 29, a conductive spring member (not shown) used to apply a voltage is provided on the same side as the spring member 46 is placed and the spring member contacts each of the above terminals to cause a high voltage to be applied to the charging roller 17, developing roller 18 and sponge roller 23. The conductive spring member used to apply the voltage is connected to a power source (not shown).

Since parts such as the transfer gear or the like are placed on the side of the driving gear 53, if the spring member used to apply the voltage is disposed on the side of the driving gear 53, configurations on the driving gear side are made complicated, which makes it difficult to ensure safety against the high voltage. In the embodiment of the present invention, as described above, since the conductive spring member used to apply the voltage is placed on the opposite side to the driving gear 53, it is possible not only to simplify the configurations on the driving gear 53 side but also to ensure safety against the high voltage. Especially, such the placement of components is effective in the color image forming apparatus in which two or more image forming cartridges 12 are placed together.

Moreover, when the open/close cover 30 shown in FIG. 2 is opened, the image forming cartridge 12 is so configured that it can be detached or attached. Since the spring member 46 shown in FIG. 1 and FIG. 4 is so configured that it can extend upward and in a slanting and outer direction, when the image forming cartridge 12 is fitted to the image forming apparatus, excellent contact between the drum shaft 16 and the spring member 46 can be achieved.

As described above, since, in the photoreceptor drum 15, the conductive drum supporting member 48 is inserted by the application of pressure or is bonded fixedly using the conductive adhesive, the photoreceptor drum 15 is in electrical contact with the drum supporting member 48. Then, since the photoreceptor drum 15 is given thrust from the direction of the arrow F, the small diameter portion of the drum supporting member 48 presses the collar 49 in a pressurized manner which causes the collar 49 to contact the E ring in a struck manner and further causes the drum supporting member 48 to reliably contact the collar 49. Further, since the drum shaft 16 is inserted in the case 14 in a positioned state, reliable contact between the end face 16*c* of the drum shaft 16 and the spring member 46 can be implemented. This, therefore, enables the photoreceptor drum 15 to be surely grounded through the drum supporting member 48, collar 49, drum shaft 16 and spring member 46.

Moreover, since the number of grounding routes of the photoreceptor drum 15 is increased by keeping the small diameter portion of the drum supporting member 48 in contact with areas surrounding the drum shaft 16, the photoreceptor drum 15 can be reliably grounded. Further, since the contact area between the drum supporting member 48 and the drum shaft 16 is small, the photoreceptor drum 15 can be rotated at a constant velocity. Furthermore, since the collar 49 is configured so as to be freely rotatable relative to the drum shaft 16, even when the collar 49 is rotated together with the drum supporting member 48, no resistance between the collar 49 and the drum supporting member 48 is produced.

Thus, according to the embodiment of the present invention, the photoreceptor drum 15 can be surely grounded through the drum supporting member 48, collar 49, drum shaft 16 and spring member 46. Since the collar 49 is in contact with the E ring 50 and then becomes in contact with the drum supporting member 48 with specified pressurized force, an electrical connection can be surely established among these components.

Since the spring member 46 is placed on the side opposite to the side on which the driving gear 53 is disposed, the configurations on the driving gear 53 side can be simplified. Moreover, it is possible to ensure safety against high voltages.

By causing the collar 49 to contact the drum shaft 16 to ground the photoreceptor drum 15, as described above, it is possible to reduce the contact area between the drum supporting member 48 and drum shaft 16. As a result, rotational friction resistance produced between the drum shaft 16 and the drum supporting member 48 is made small, thus enabling the photoreceptor drum 15 to be rotated at a constant velocity. Since there is no need for placement of any bearing between the drum supporting member 48 and the drum shaft 16, no increase in the number of components occurs. Thus, costs can be reduced.

Moreover, since there is no need for placement of a plate spring used to ground the drum shaft 16 in the photoreceptor drum 15, the device is easily assembled and costs can be reduced accordingly. Since momentum is given to the image forming cartridge 12 in the direction opposite to the side on which the driving gear 53 is placed, easy positioning of the image forming cartridge 12 relative to the frame 29 can be achieved.

Also, by shaping the collar 49 into a collar whose diameter is made larger toward the drum supporting member 48 as shown in FIG. 8 and by attaching the collar 49 in a manner as shown in FIG. 9, the contact area between the collar 49 and drum supporting member 48 can be increased and the drum supporting member 48 can be integrally rotated together with the collar 49, which enables the drum supporting member 48 to be reliably connected to the collar electrically and also enables the photoreceptor drum 15 to be surely grounded.

Figure 10:
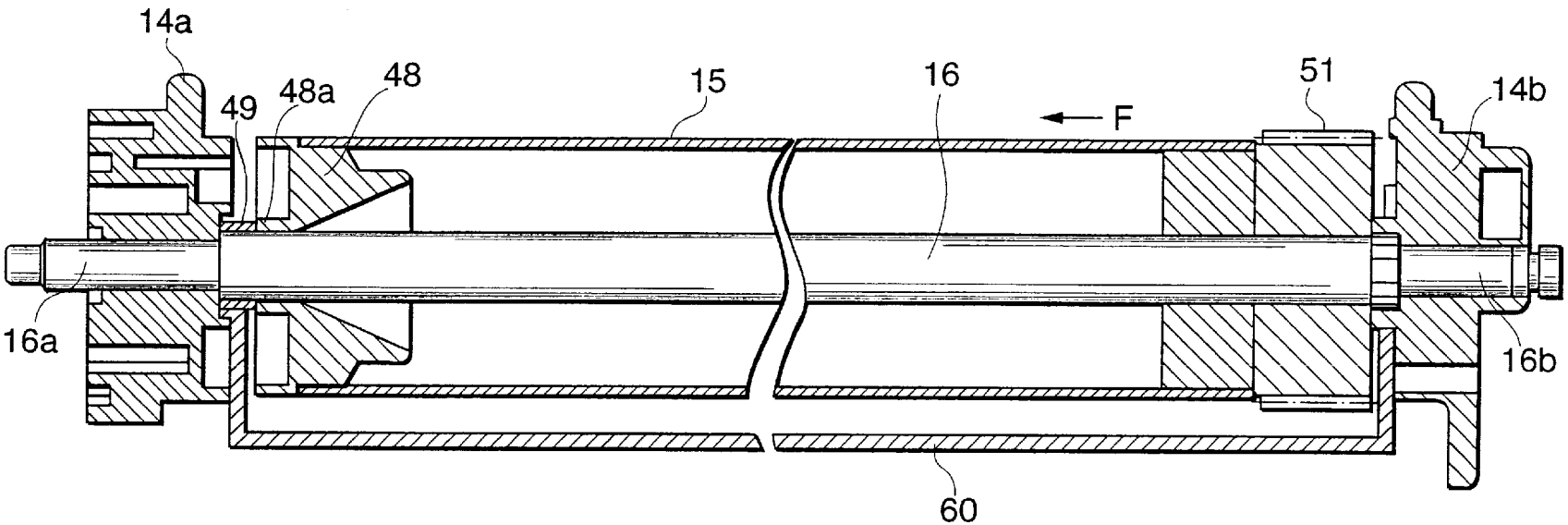
FIG. 10 is a cross-sectional view describing configurations of main portions of an image forming cartridge according to another embodiment of the present invention.

FIG. 10 is a cross-sectional view describing configurations of main portions of an image forming cartridge according to another embodiment of the present invention. In this embodiment, each of side walls 14*a* and 14*b* of the cartridge case 14 is fixed to ends of the frame 60 and are coupled to each other. One end 16*b* of the drum shaft 16 is inserted by the application of pressure in a fixed manner and further its tip extrudes from the side wall 14*b* and is inserted into the frame 29*b* (not shown) in an involved manner (refer to FIG. 1).

On the other hand, the other end 16*a* of the drum shaft 16 is inserted into the side wall 14*a* in a penetrated manner. On a circumferential face positioned between the side wall 14*a* of the drum shaft 16 and the drum supporting member 48 is provided a collar 49 made of a conductive metal in a manner so as to be rotational and movable.

In this embodiment, the side wall 14*a* is used as a stopper, instead of the E ring used in the first embodiment. That is, when the photoreceptor drum 15 is given thrust F by the gear 51, since the small diameter portion 48*a* of the drum supporting member 48 presses the collar 49 in a pressurized manner to cause the collar 49 to contact the side wall 14*a* in a struck manner, reliable contact between the small diameter portion 48*a* and the collar 49 can be achieved. Therefore, the photoreceptor drum 15 can be surely grounded through the drum supporting member 48, collar 49, drum shaft 16 and spring member 46 (refer to FIG. 1).

Moreover, in this embodiment, the other end 16*a* of the drum shaft 16 may be inserted into the side wall 14*a* by the application of pressure and in a penetrated manner.

Figure 11:
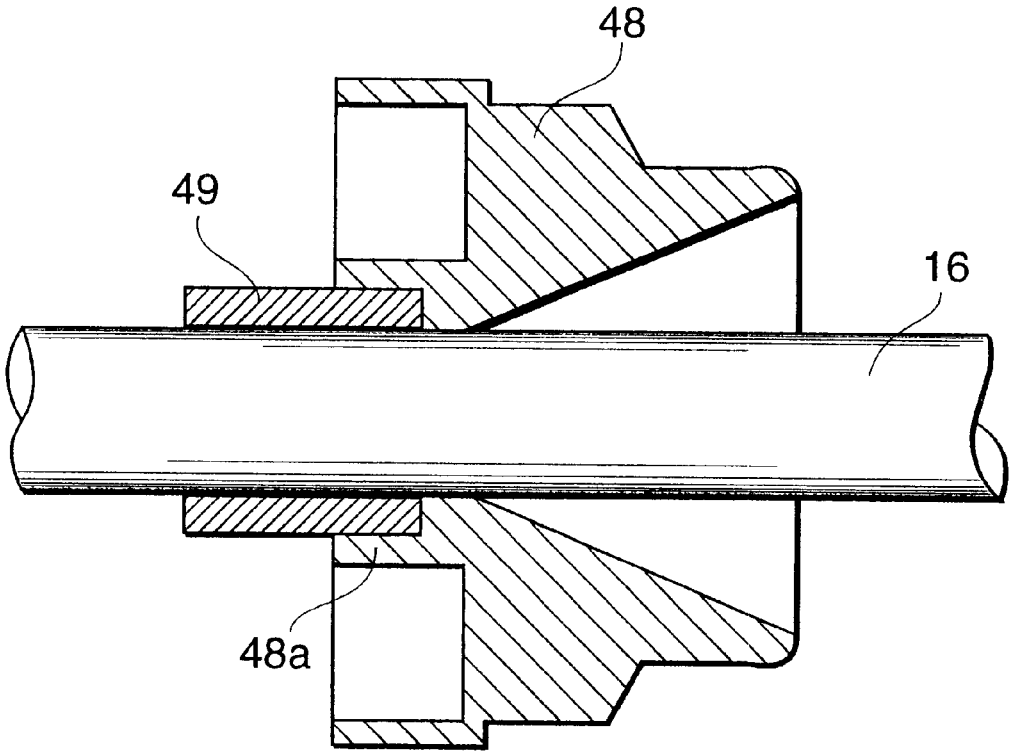
FIG. 11 is a cross-sectional view explaining another way of attaching the collar made of a conductive metal employed in the present invention.
Figure 12:
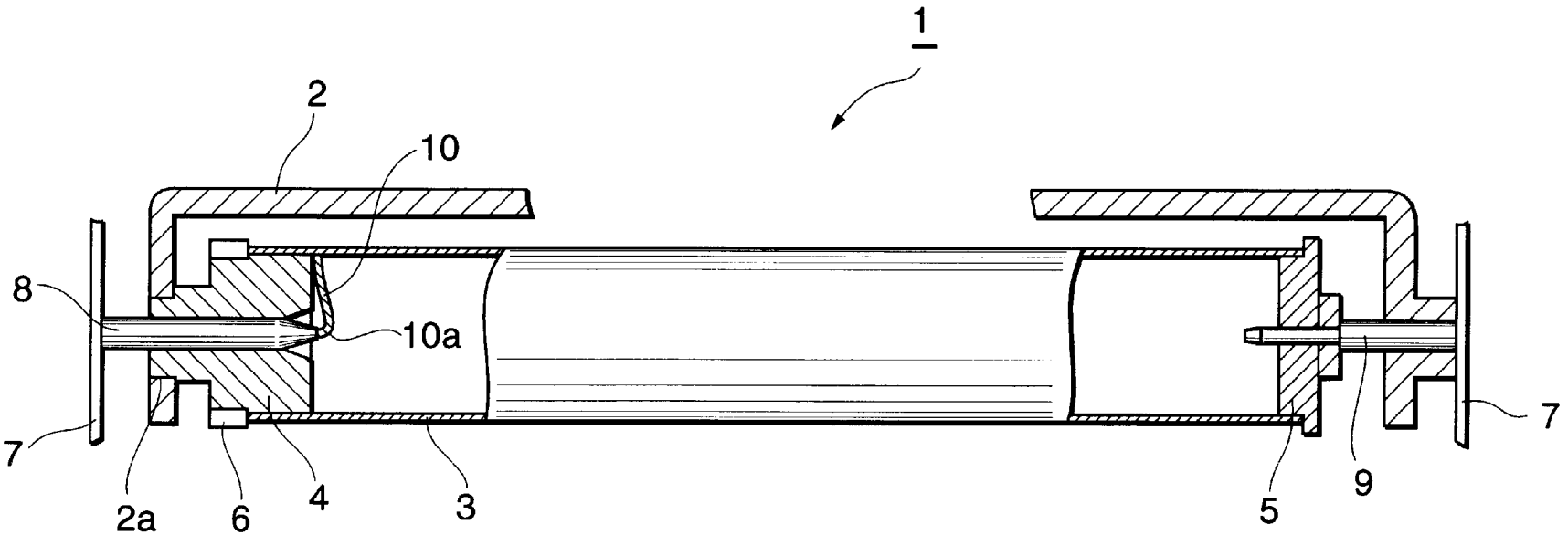
FIG. 12 is a cross-sectional view describing configurations of main portions of a conventional image forming cartridge.

FIG. 11 is a cross-sectional view explaining another way of attaching the collar made of a conductive metal employed in the present invention. As shown in FIG. 11, a part of the collar 49 is inserted, by the application of pressure, into a ring-shaped concave portion of the small diameter portion 48*a* of the drum supporting member 48 and is placed on the drum shaft 16. Moreover, the part of the collar 49 may be inserted into the ring-shaped concave portion of the small diameter portion 48*a* in a manner so as to be rotational.

Thus, according to the present invention, since the image forming cartridge having a photoreceptor drum disposed in the cartridge case and being installed to the image forming apparatus through the cartridge case in a manner so as to be detachable and attachable is provided with the electrically conductive axial member being disposed on the rotation center axis and being supported by the cartridge case, the electrically conductive drum supporting member being attached to the axial member in a manner so as to be rotational and movable and being adapted to support the photoreceptor drum on the axial member in a manner so as to be rotational, the collar attached to a circumferential face near the drum supporting member of the axial member in a manner so as to be rotational and movable and is composed of a conductive material to ground the photoreceptor drum through the axial member, the thrust supplying unit used to give thrust to the photoreceptor drum to press the drum supporting member, by the application of pressure and through the photoreceptor drum, on the collar so as to cause the drum supporting member to contact the collar and the stopper used to prevent said pressed collar from moving on said axial member, the photoreceptor drum can be reliably grounded. As a result, it is possible to prevent the image quality from being lowered and to prevent malfunctions caused by noise from occurring.

Moreover, according to the present invention, by reducing the contact area between the drum supporting. member and the axial member, the photoreceptor drum can be surely grounded. This enables the sliding resistance between the axial member and the drum supporting member can be made small, thus allowing the photoreceptor drum to be rotated at a constant velocity.

It is thus apparent that the present invention is not limited to the above embodiments but may be changed and modified without departing from the scope and spirit of the invention.

What is claimed is:

1. An image forming cartridge, comprising:

a cartridge case;

a photoreceptor drum disposed in said cartridge case and being removably attachable to an image forming apparatus through said cartridge case;

an electrically conductive axial member disposed on a rotation center axis of said photoreceptor drum and being supported by said cartridge case;

an electrically conductive drum supporting member placed on said axial member so as to be rotatable and movable, and supporting said photoreceptor drum on said axial member so that said photoreceptor drum is rotatable;

an electrically conductive collar placed on a circumferential face of said axial member and near said drum supporting member so as to be rotatable and movable;

a thrust supplying unit that applies thrust to said drum supporting member, so that said drum supporting member presses on and contacts said collar; and a stopper that prevents said collar from moving on said axial member when said collar is pressed by said drum supporting member.

2. The image forming cartridge according to claim 1, wherein said drum supporting member is formed of a conductive resin and has a cone-shaped placement hole used to reduce an area that contacts, faces and surrounds said axial member.

3. The image forming cartridge according to claim 1, further comprising an elastic member used for grounding which is fixable to a frame; and wherein an end of said axial member penetrates said cartridge case and contacts said elastic member.

4. The image forming cartridge according to claim 1, wherein said thrust supplying unit includes a rotatable helical gear which is fixed coaxially to an end of said photoreceptor drum, and a driving helical gear which engages with said rotatable helical gear.

5. The image forming cartridge according to claim 1, wherein said stopper is a ring member that is fixed to the circumferential face of said axial member.

6. The image forming cartridge according to claim 1, wherein said stopper is a wall of said cartridge case that faces and is disposed opposite to said collar.

7. An image forming cartridge, comprising:

a cartridge case;

a photoreceptor drum disposed in said cartridge case and being removably attachable to an image forming apparatus through said cartridge case;

a shaft disposed on a rotation center axis of said photoreceptor drum, and having opposing first and second ends that are supported, in a fixed manner, by said cartridge case;

a drum supporting member, composed of a conductive resin, fixed internally on a side of a first end of said photoreceptor drum, and being disposed on a circumferential face of said shaft and on a side of the first end of said shaft so as to be rotatable and movable, and supporting said photoreceptor drum on said shaft so that said photoreceptor drum is rotatable;

a conductive collar placed on the circumferential face of said shaft and near said drum supporting member so as to be rotatable and movable, said photoreceptor drum being grounded through said shaft and said conductive collar;

first and second helical gears, said first helical gear being coaxially fixed to a second end of said photoreceptor drum and being placed on the circumferential face on a side of the second end of said shaft, said first helical gear engaging with said second helical gear, said second helical gear being for driving said image forming apparatus, and said first helical gear applying thrust to said photoreceptor drum to press said drum supporting member, by application of pressure and through said photoreceptor drum, on said collar so as to cause said drum supporting member to contact said collar; and a stopper that prevents said collar from moving on said shaft when said collar is pressed by said drum supporting member.

8. The image forming cartridge according to claim 7, wherein said drum supporting member has a cone-shaped placement hole used to reduce an area that contacts, faces and surrounds said shaft, and has a small diameter portion that contacts, faces and surrounds said shaft.

9. The image forming cartridge according to claim 7, further comprising an elastic member used for grounding which is fixable to a frame; and wherein the first end of said shaft penetrates said cartridge case and contacts said elastic member.

10. The image forming cartridge according to claim 7, wherein said stopper is a ring member that is fixed to the circumferential face of said shaft.

11. The image forming cartridge according to claim 7, wherein said stopper is a wall of said cartridge case that faces and is disposed opposite to said collar.

12. An image forming apparatus, comprising:

a rotatable photoreceptor drum;

an electrically conductive axial member that is supported and rotatable on a rotation center axis of said photoreceptor drum;

an electrically conductive drum supporting member placed on said axial member so as to be rotatable and movable, and supporting said photoreceptor drum on said axial member so that said photoreceptor drum is rotatable;

an electrically conductive collar placed on a circumferential face of said axial member and near said drum supporting member so as to be rotatable and movable;

a thrust supplying unit that applies thrust to said drum supporting member, so that said drum supporting member presses on and contacts said collar; and a stopper that prevents said collar from moving on said axial member when said collar is pressed by said drum supporting member.

13. The image forming apparatus according to claim 12, wherein said drum supporting member is formed of a conductive resin and has a cone-shaped placement hole used to reduce an area that contacts, faces and surrounds said axial member.

14. The image forming apparatus according to claim 12, wherein said thrust supplying unit includes a rotatable helical gear which is fixed coaxially to an end of said photoreceptor drum, and a driving helical gear which engages with said rotatable helical gear.

15. The image forming apparatus according to claim 12, wherein said stopper is a ring member that is fixed to the circumferential face of said axial member.

16. An image forming cartridge, comprising:

an axial member;

a drum supporting member placed on said axial member;

a collar disposed on said axial member and near said drum supporting member;

a thrust supplying unit that applies a thrust to said drum supporting member, so that said drum supporting member presses on and contacts said collar; and a stopper that prevents said collar from moving on said axial member when said collar is pressed by said drum supporting member.

* * * * *